US011401856B2

(12) United States Patent
Pawellek

(10) Patent No.: US 11,401,856 B2
(45) Date of Patent: Aug. 2, 2022

(54) PUMP DEVICE FOR A COOLING CIRCUIT OF AN INTERNAL COMBUSTION ENGINE OF A COMMERCIAL OR MOTOR VEHICLE

(71) Applicant: NIDEC GPM GmbH, Auengrund OT Merbelsrod (DE)

(72) Inventor: Franz Pawellek, Lautertal (DE)

(73) Assignee: NIDEC GPM GMBH, Auengrund OT (DE)

( * ) Notice: Subject to any disclaimer, the term of this patent is extended or adjusted under 35 U.S.C. 154(b) by 0 days.

(21) Appl. No.: 17/529,324

(22) Filed: Nov. 18, 2021

(65) Prior Publication Data

US 2022/0154625 A1 May 19, 2022

(30) Foreign Application Priority Data

Nov. 19, 2020 (DE) ..... 102020130553.2

(51) Int. Cl.
*F01P 5/12* (2006.01)
*F01P 7/14* (2006.01)
*F01P 5/10* (2006.01)

(52) U.S. Cl.
CPC ..... *F01P 5/12* (2013.01); *F01P 7/14* (2013.01); *F01P 2005/105* (2013.01); *F01P 2007/146* (2013.01)

(58) Field of Classification Search
CPC ..... F01P 5/12; F01P 7/14; F01P 2005/105; F01P 2007/146; F04B 23/04; F04B 17/03
See application file for complete search history.

(56) References Cited

U.S. PATENT DOCUMENTS 4,413,596 A * 11/1983 Hirayama ..... G05D 23/1393 123/41.1
4,539,942 A * 9/1985 Kobayashi ..... G05D 23/24 123/41.1
4,759,316 A * 7/1988 Itakura ..... F01P 7/167 123/41.1
5,497,941 A * 3/1996 Numazawa ..... B60W 10/30 219/205
6,786,183 B2 * 9/2004 Hoelle ..... B60H 1/08 123/41.44
7,243,620 B2 * 7/2007 Takahashi ..... F01P 3/02 123/41.1
8,869,756 B2 * 10/2014 Bilezikjian ..... F01P 5/12 123/41.44
2004/0050543 A1 * 3/2004 Kim ..... F28D 1/05375 165/300
2005/0144949 A1 * 7/2005 Hamada ..... F01K 23/065 60/670
2011/0123365 A1 * 5/2011 Buchholz ..... F04D 13/021 417/362

(Continued)

FOREIGN PATENT DOCUMENTS

DE 301909 A 11/1917
DE 196 53 636 A1 6/1998
DE 10 2018 104 784 A1 9/2019

*Primary Examiner* — Hung Q Nguyen
(74) *Attorney, Agent, or Firm* — Keating & Bennett

(57) ABSTRACT

A pump device for a cooling circuit of an internal combustion engine of a commercial or motor vehicle includes two electric pumps in parallel, each of which includes a switchable backflow valve in a suction line, so that the electric pumps can be operated selectively individually or in parallel.

22 Claims, 7 Drawing Sheets

(56) References Cited

U.S. PATENT DOCUMENTS

2012/0247715 A1* 10/2012 Renner ..... B60L 3/003
165/42
2013/0333863 A1* 12/2013 Pawellek ..... F04D 13/12
165/104.19

* cited by examiner

PUMP DEVICE FOR A COOLING CIRCUIT OF AN INTERNAL COMBUSTION ENGINE OF A COMMERCIAL OR MOTOR VEHICLE

CROSS REFERENCE TO RELATED APPLICATION

The present application claims priority under 35 U.S.C. § 119 to German Application No. 10 2020 130 553.2, filed on Nov. 19, 2020, the entire contents of which are hereby incorporated herein by reference.

1. FIELD OF THE INVENTION

The present disclosure relates to a pump device of a cooling circuit of an internal combustion engine of a commercial or motor vehicle, to a commercial or motor vehicle, and to a method for operating such a pump device.

2. BACKGROUND

In the commercial vehicle (CV) sector, controllable mechanical main water pumps or combinations of mechanical main water pumps with electrical auxiliary pumps are conventionally used for cooling combustion engines. The main water pumps are designed for maximum engine load at high engine speeds and are therefore often oversized in operating conditions with low engine speeds. Their flow rate is exclusively linked to the engine speed—and not to the actual cooling demand corresponding to the operating condition of the engine. The motor of the pump must therefore apply a mechanical power of up to two kilowatts for its function in the cooling circuit. In addition, the controllability of mechanical pumps is limited. The fuel-saving potential that could be achieved through flow rate control is therefore not fully exploited.

SUMMARY

Example embodiments of the present disclosure provide pump devices to each supply coolant to an internal combustion engine of a commercial or motor vehicle, with improved efficiency.

Example embodiments of the present disclosure provide a pump device of a cooling circuit of an internal combustion engine of a commercial or motor vehicle, a commercial or motor vehicle, and a method of operating such a pump device.

A pump device according to an example embodiment of the present disclosure provided to a cooling circuit of an internal combustion engine of a commercial or motor vehicle includes two electric pumps in parallel, each of which includes a switchable backflow valve in a suction line, so that the electric pumps can optionally be operated individually or in parallel. Trucks mainly drive in the partial load range. The volume flow required can be provided in a single operation. The efficiency of the pump device can thus be increased considerably, because the pump efficiency when operating a small pump close to a design point is higher than a pump efficiency of a larger pump in a partial load range.

Preferably, the switchable backflow valves are 2/2-way valves, which can be actuated pneumatically or electrically.

Preferably, the switchable backflow valves prevent a backflow of a coolant in the cooling circuit when in a blocking position, so that the electric pumps cannot cause coolant to flow through in a direction opposite to the conveying direction.

One of the electric pumps may define a main pump which is operated in a normal condition and whose associated switchable backflow valve is in the flow position, the second of the electric pumps defining a secondary pump which is switched off in the normal condition and whose associated switchable backflow valve is in the blocking position. The pumping device is then operated in a single mode. It may be advantageous if, in a single operation, the pumps alternate so that the running time can be distributed equally between the two pumps.

Preferably the electric pumps are identical. Costs for the construction of a larger pump can thus be saved. By having a larger number of identical pumps, manufacturing costs can also be kept low. The presence of two identical pumps also creates redundancy in case of failure of one of the pumps.

Preferably, the pump device includes an adapter housing in which the switchable backflow valves are located, the electric pumps being attachable to the adapter housing and the adapter housing including an interface to an internal combustion engine. The pump device can thus be connected to already existing interfaces and can be easily retrofitted.

Preferably, the adapter housing includes a flange side to connect to a cooling circuit of an internal combustion engine, to which an suction flange including a third sealing surface and a discharge flange including a fourth sealing surface are provided. The adapter housing further includes a pump side opposite the flange side to connect to the electric pumps. The adapter housing further includes a first discharge line and a second discharge line, the suction lines, and a first pump working space adjoining a first of the suction lines and surrounded by a first sealing surface, and a second pump working space adjoining a second of the suction lines and surrounded by a second sealing surface, and a valve assembly including the two switchable backflow valves, which are adjustable between a blocking position and an open position. At least one of the pump working chambers defines an opening in the pump side, preferably each pump working chamber defines an opening in the pump side, and the discharge flange is connected to the two discharge lines via a discharge connection piece, and the suction flange is connected to the two suction lines via a suction connection. In each case a switchable backflow valve cooperates with one of the two suction lines and closes the corresponding suction line in the closed position and releases the corresponding suction line in the open position.

The switchable backflow valves can preferably be operated from the outside.

It is advantageous if the suction connection downstream of the suction flange opening is divided into the two suction lines.

Preferably, the discharge lines join to define the discharge port located upstream of the discharge flange opening.

Preferably, the suction manifold has a larger cross-section than one of the suction lines.

In addition, it is advantageous if the discharge port has a larger cross-section than one of the discharge lines.

In an advantageous example embodiment, a first one of the two switchable backflow valves is located in a transition region between the first suction line and the first pump working chamber, and a second one of the two switchable backflow valves is located in a transition region between the second suction line and the second pump working chamber.

Furthermore, a commercial or motor vehicle is provided with an internal combustion engine which can be cooled by a cooling circuit, and with a pump device described above which is adapted to circulate a coolant in the cooling circuit.

The pump device is preferably connected to the corresponding internal combustion engine via the suction flange and the discharge flange.

An example embodiment of a method of operating a previously described pump apparatus includes the steps of, in the event that the required flow rate in the cooling circuit is low, at or below a predetermined threshold value, operating the pumping device in a single mode, with the backflow valve of the operated electric pump in a flow position and the backflow valve of the switched-off electric pump in a blocking position; and in the event that the required flow rate in the cooling circuit is high, at or above a predetermined threshold value, operating the pumping device in a parallel mode, with both electric pumps operating and the backflow valves in the flow position.

Preferably, the method includes the following additional steps of, in the event of failure of one of the electric pumps, operating the other electric pump, and setting the associated backflow valve to the flow position, and setting the backflow valve of the faulty pump to the blocking position.

The pump device is preferably a portion of a commercial or motor vehicle with an internal combustion engine, the internal combustion engine being cooled by a cooling circuit with the pump device circulating coolant in the cooling circuit.

The above and other elements, features, steps, characteristics and advantages of the present disclosure will become more apparent from the following detailed description of the example embodiments with reference to the attached drawings.

BRIEF DESCRIPTION OF THE DRAWINGS

In the following, example embodiments of the present disclosure are described with reference to the drawings. Identical components or components with identical functions bear identical reference signs.

DETAILED DESCRIPTION

Figure 1:
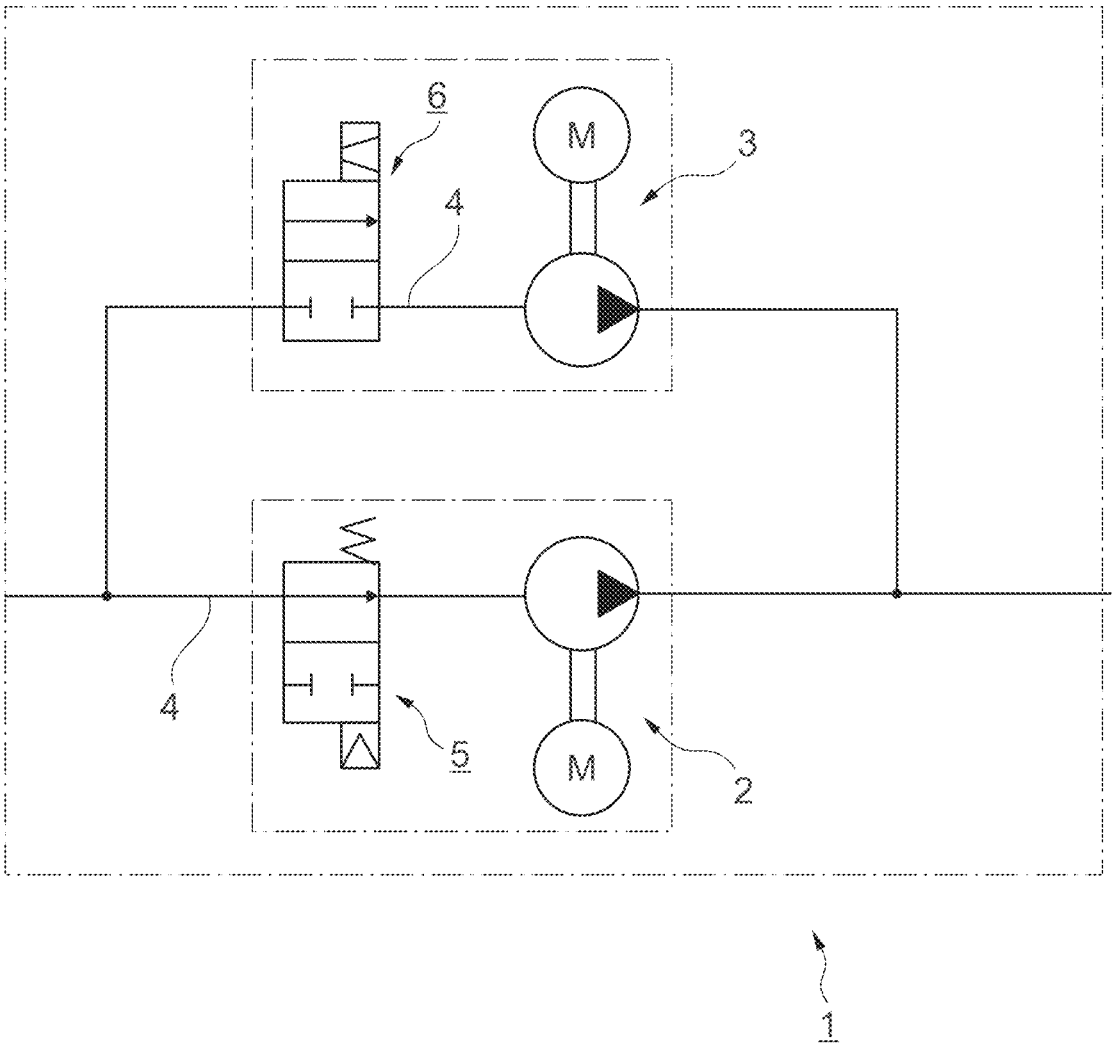
FIG. 1 is a block diagram of a pump device according to an example embodiment of a coolant circuit of an internal combustion engine of a commercial vehicle according to the present disclosure.

FIG. 1 shows a circuit diagram of a pump device 1 according to an example embodiment of the present disclosure. The pump device 1 is a portion of a coolant circuit of an internal combustion engine in commercial vehicles. Driven by the pump device 1, a coolant circulates in the cooling circuit and causes cooling of the internal combustion engine. The coolant is preferably water.

The pump device 1 preferably includes two identical electric pumps 2,3 connected in parallel. In the respective suction line 4 of the two pumps 2,3, a backflow flow valve 5,6 is provided in each case. The backflow valves 5,6 are switchable. One of the electric pumps 2 defines the main pump. The other electric pump 3 serves as a slave pump. The first backflow flow valve 5 arranged upstream of the main pump 2 is spring-biased and pneumatically operable. When the main pump 2 is operated, the backflow flow valve 5 can be flowed through in a flow position in the delivery direction. When the main pump 2 is switched off, the first backflow flow valve 5 is actuated and transferred into a blocking position against the spring force. The second backflow valve 6, which is arranged upstream of the secondary pump 3 in the direction of flow, can be actuated electrically by means of an electromagnet which has two windings acting in opposite directions. In the event that the secondary pump 3 is not operated, the second backflow valve 6 is in a blocking position. If, on the other hand, the secondary pump 3 is used, the second backflow valve 6 is transferred to a flow position.

Commercial vehicles, especially trucks, mainly drive in the partial load range, the required volume flow can then be generated by a single one of the two electric pumps 2,3. The backflow valves 5,6 in the suction area of the electric pumps 2,3 prevent an undesired backflow of the coolant through the passive electric pump in single operation. The pump efficiency is increased, as this is greater with a smaller pump being operated close to the design point than the pump efficiency of a large pump in the partial load range.

In single operation, due to the two identical pumps 2,3, it is possible to switch between the two pumps and divide the running times equally between the two pumps. In case of increased cooling demand, both electric pumps 2,3 are operated in parallel.

The presence of two pumps 2,3 of the same type creates redundancy in case of failure of one pump. If an electric pump 2,3 fails in single operation, the functional pump can replace the failed pump, as they are identical in construction. In parallel operation, if one pump fails, the functional pump can generate a reduced volume flow to cool the combustion engine. In addition, the use of two identical pumps is more cost-effective, since only one pump type has to be designed and this can be produced in higher quantities.

It is also conceivable that the pump device is used in motor vehicles. Here, too, the above-mentioned advantages result.

Figure 2:
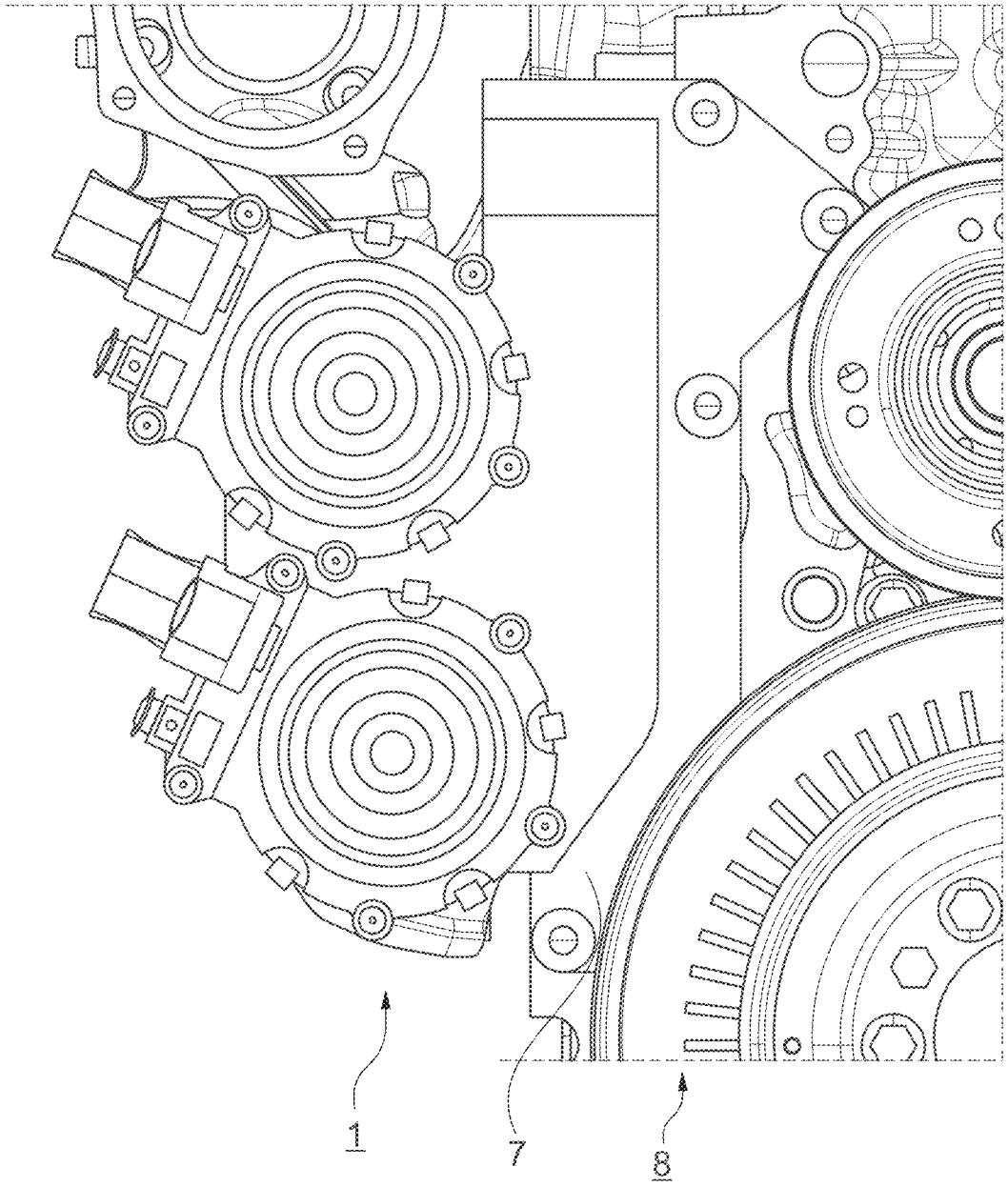
FIG. 2 is an illustration of a pump device according to an example embodiment of the present disclosure with two electric pumps.

FIG. 2 shows a side view of the pump device 1. The pump device 1 includes a special adapter housing 7, which defines an interface to the combustion engine 8. Retrofitting of the pump device 1 in already existing systems is thus possible. The two backflow valves are installed in the adapter housing 7, which prevent the coolant from flowing back in the blocked position.

Figure 3:
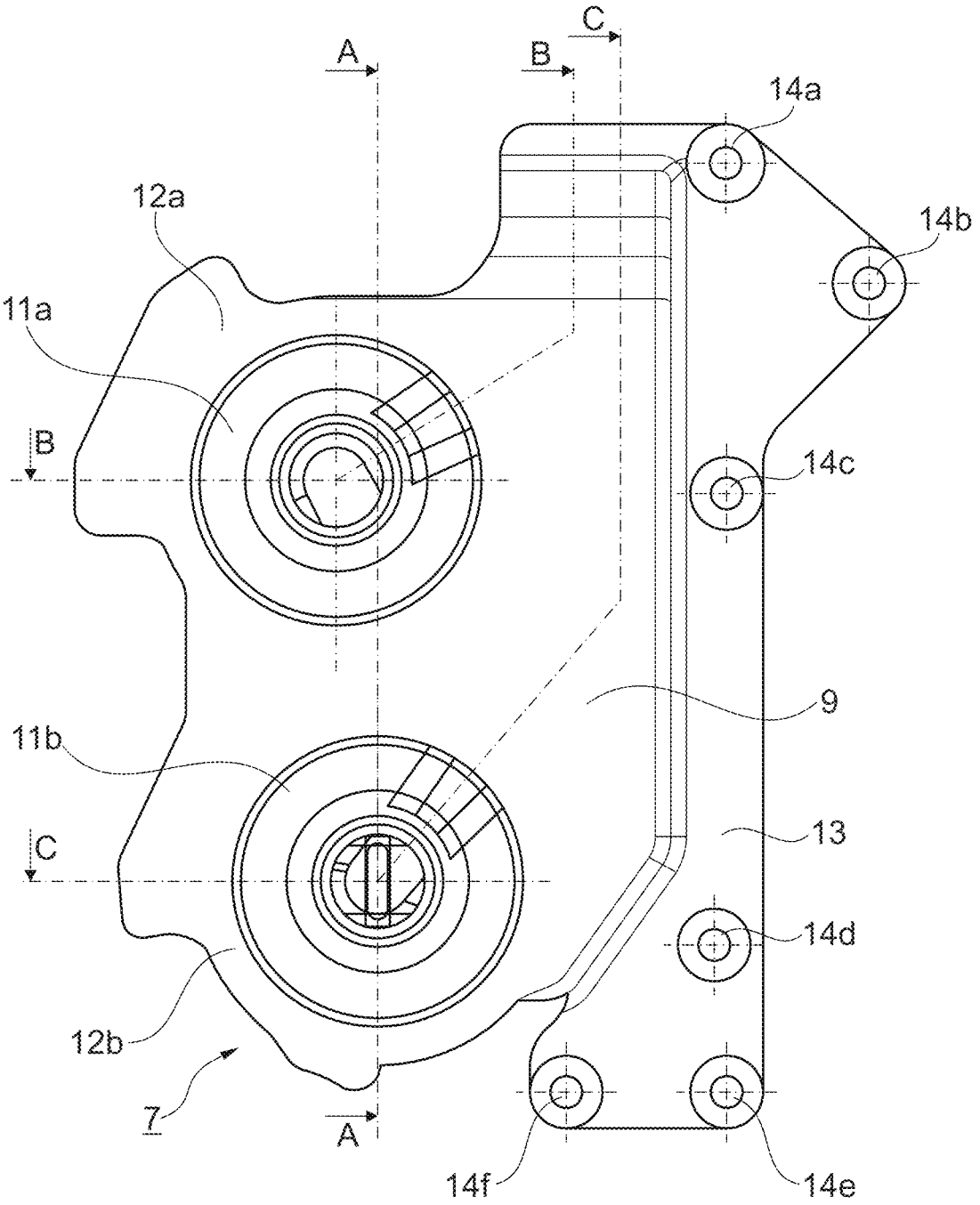
FIG. 3 is a view of the pump side of an adapter housing of a pump device.
Figure 4:
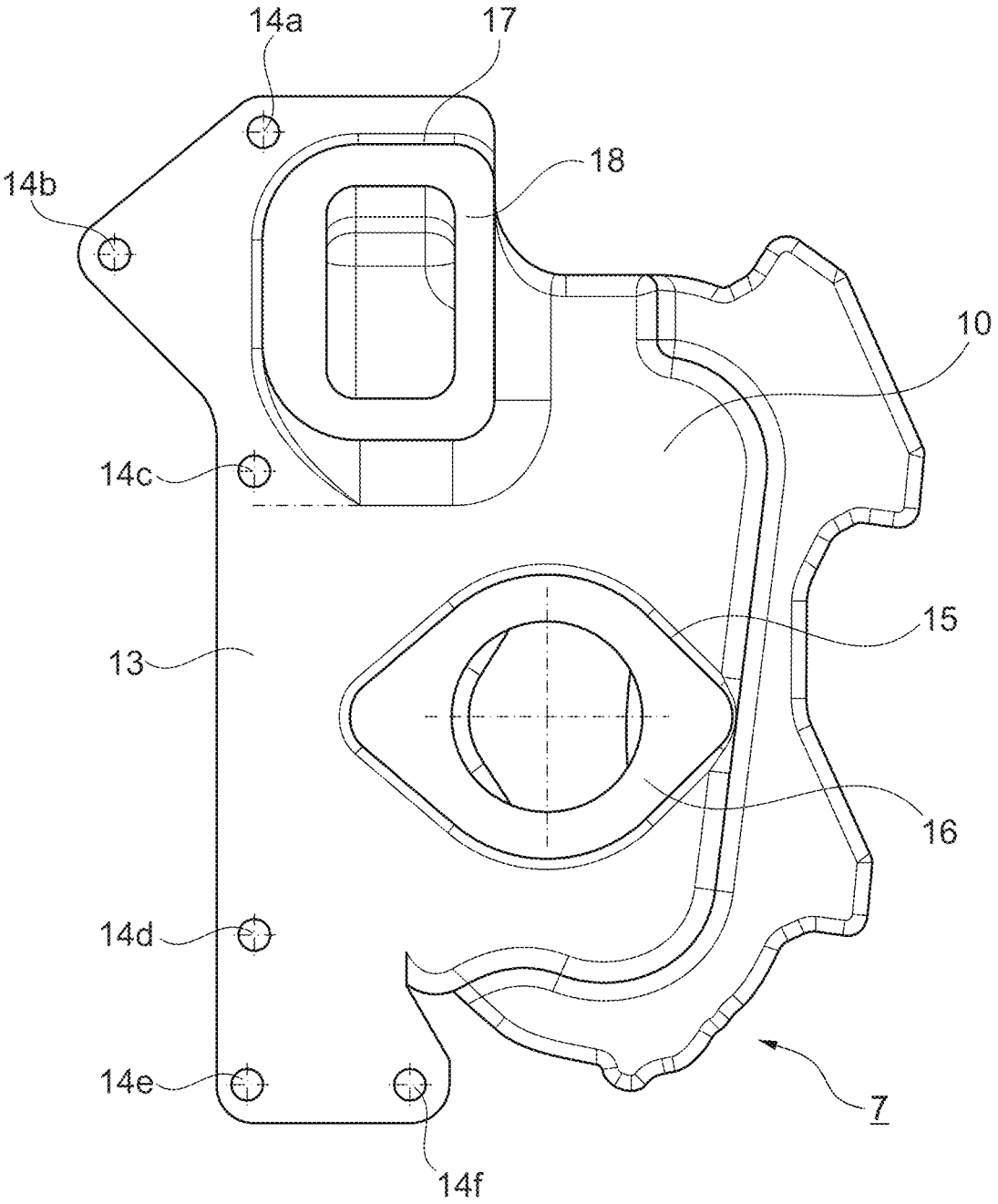
FIG. 4 is a view of the flange side of an adapter housing.

FIGS. 3 and 4 show the adapter housing 7 of the pump device 1. This includes a pump side 9 and a flange side 10 opposite the pump side. For connection to an internal combustion engine 4, the circumferential edge sides of the adapter housing 1 are structured in accordance with the necessary installation space dimensions and the requirements of the installing space and structures. As shown in FIG. 3, two pump working spaces 11*a*, 11*b* are on the pump side 9 in the adapter housing 7. These pump working spaces 11*a*, 11*b* are preferably defined by cylindrical recesses on the adapter housing 7.

A rotational symmetry axis A passes perpendicularly through the center of the base of a first pump working space 11*a*. A rotational symmetry axis B extends perpendicularly through the center of the base surface of a second pump working chamber 11*b*. The first pump working space 11*a* is surrounded by a first sealing surface 12*a* on the pump side of the adapter housing. The second pump working space 11*b* is surrounded by a second sealing surface 12*b* on the pump side of the adapter housing. The sealing surfaces 12*a*, 12*b* define planar contact surfaces so that a respective planar sealing surface of a flange of an electric pump can be brought into contact with a sealing surface 12*a*, 12*b*. Thus, an electric pump can be connected to a respective pump working chamber 11*a*,11*b*. The electric pumps not shown are preferably identical. However, it may also be provided that two different electric pumps, in particular a main pump and a secondary pump, are connectable to the pump working spaces 11*a*, 11*b*. On one edge, the pump side 9 is defined as a mounting flange 13 with which the adapter housing 7 can be connected to an internal combustion engine 8. The fastening flange 13 includes recesses 14*a*-14*f* through which, for example, fastening screws (not shown) can be guided to fasten the adapter housing 7 to the internal combustion engine 8. As shown in FIG. 4, the adapter housing 7 includes on the flange side 10 a suction flange 15 with a sealing surface 16 running around the flange side and a discharge flange 17 with a circumferential sealing surface 18 for connection to the internal combustion engine 8.

Figure 5:
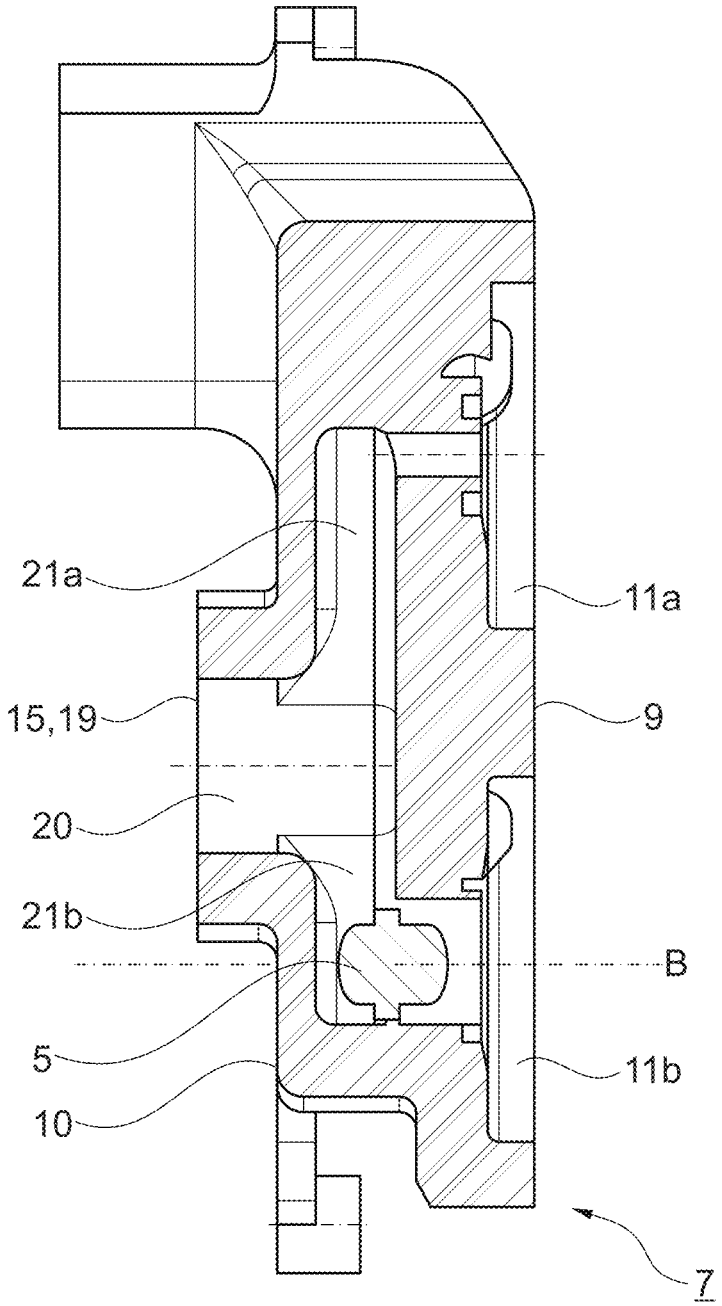
FIG. 5 is a sectional view through the adapter housing along a sectional line A-A according to FIG. 3.
Figure 6:
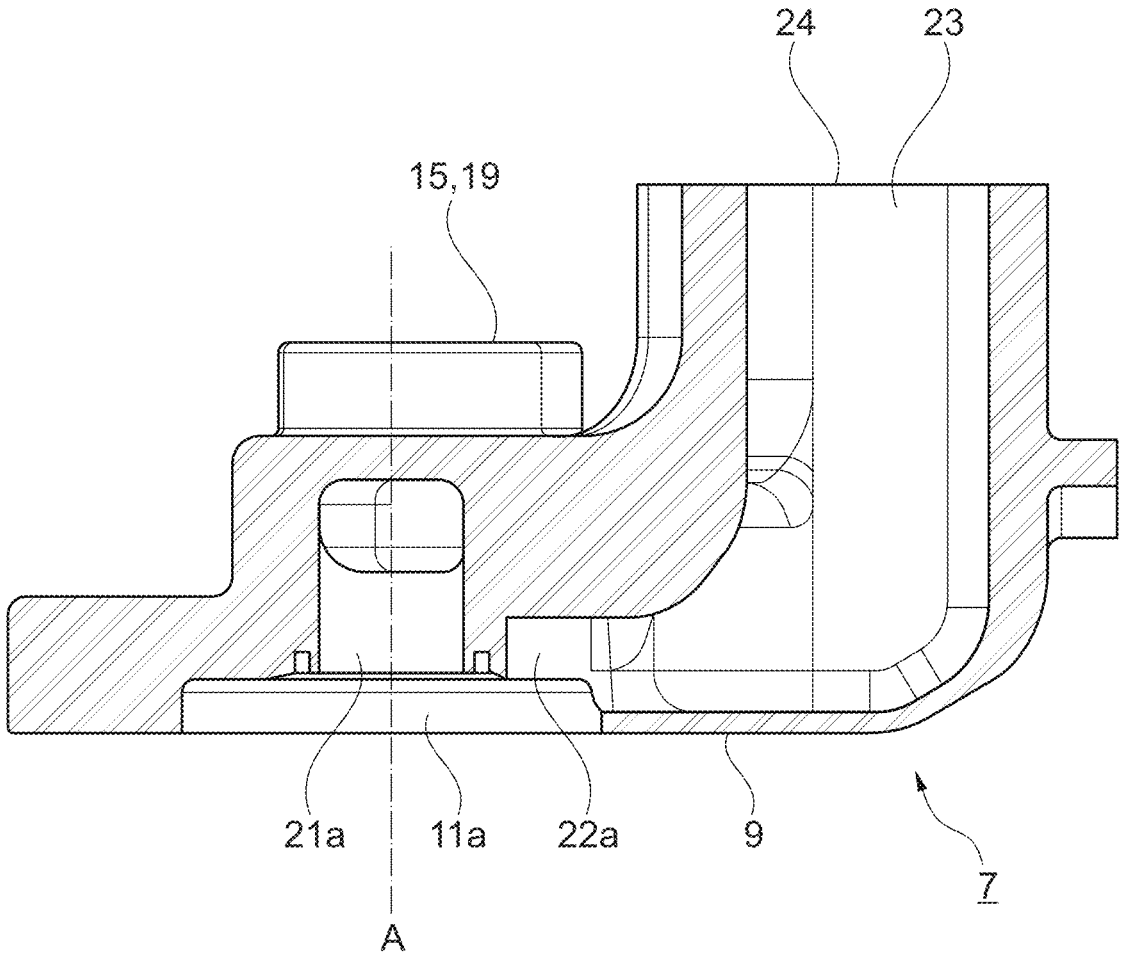
FIG. 6 is a sectional view through the adapter housing along a sectional line B-B according to FIG. 3.
Figure 7:
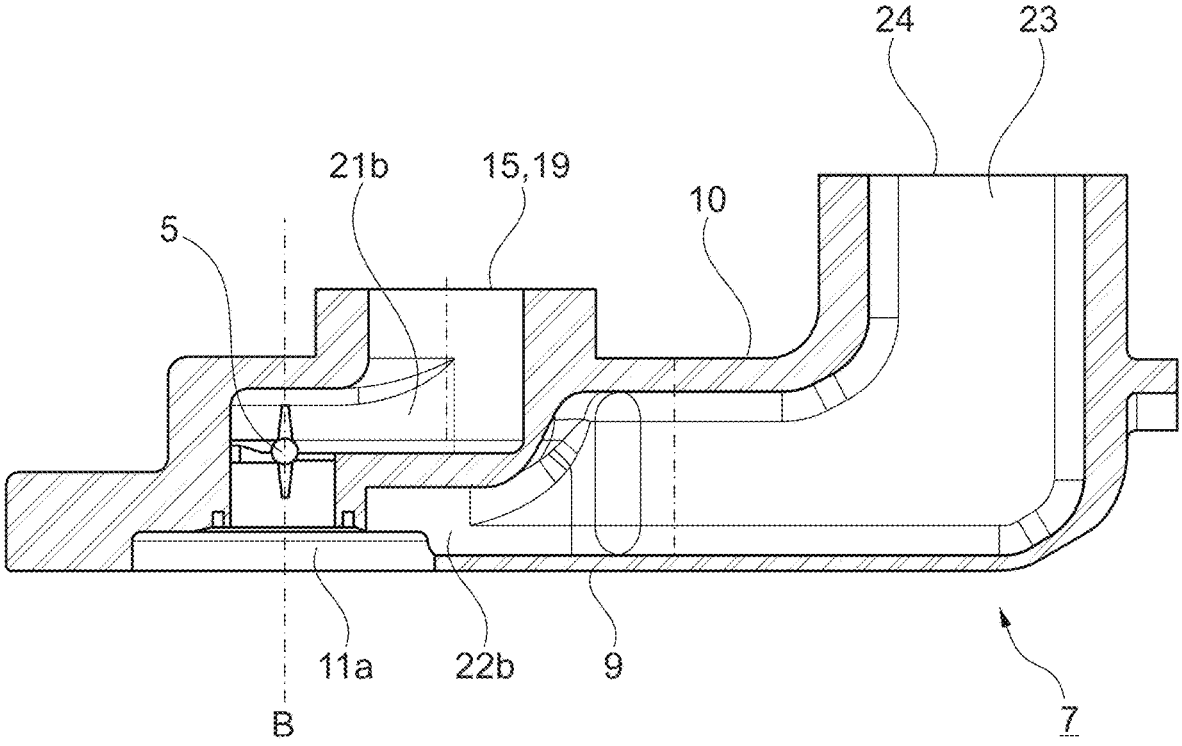
FIG. 7 is a sectional view through the adapter housing along a sectional line C-C according to FIG. 3.

FIGS. 5 to 7 show sectional views through the adapter housing 7. The suction flange 15, which is arranged on the flange side 10 of the adapter housing 7, includes a suction flange opening 19. The suction flange opening 19 also defines the opening of a suction port 20. The suction port 20 is preferably a channel inside the suction flange 15, which runs parallel to the axes of rotational symmetry A, B. According to FIG. 5, which shows a section through the adapter housing 7 along a section line A-A marked in FIG. 1 and the axis of rotational symmetry B, two suction lines 21*a*,21*b*, which run in a radial direction with respect to an axis of rotational symmetry of the suction port 20, the latter running parallel to the axes of rotational symmetry A,B of the pump working spaces 11*a*,11*b*, and each running in the direction of a pump working space 11*a*,11*b*. In a transition region between a radial portion of the first suction line 21*a* and the first pump working space 11*a*, the radial portion of the first suction line 21*a* merges, by a right-angled deflection, into a parallel portion of the first suction line 21*a* which extends parallel to the rotational symmetry axis A and connects the radial portion of the first suction line 21*a* to the first pump working space 11*a*. In a transition region between a radial portion of the second suction conduit 21*b* and the second pump working chamber 11*b*, the radial portion of the second suction conduit 21*b* merges, by a right-angled deflection, into a parallel portion of the second suction conduit 21*b* which runs parallel to the axis of rotational symmetry B and connects the radial portion of the second suction conduit 21*b* to the second pump working chamber 11*b*. One pump working chamber 11*a*,11*b* is connected to each suction conduit 21*a*,21*b*. The first pump working space 11*a* is connected to the first suction conduit 21*a*. The second pump working chamber 11*b* connects to the second suction conduit 21*b*. In a further example embodiment, at least one of the pump working spaces 11*a*,11*b* may be defined in the pump side 9 of the adapter housing 7. The other of the pump working spaces 11*a*,11*b* may be defined in the pump side 9 or in the flange side 10 of the adapter housing 7. A first one of the backflow valves 5 is arranged in a parallel portion of the suction conduit 15*b*. The adjusting element 16 preferably includes a valve flap which is rotatably mounted about an axis of rotation. A discharge line 22*a*,22*b* is connected to each of the pump working chambers 11*a*,11*b*. A first discharge line 22*a* is connected to the first pump working chamber 11*a*. As shown in FIG. 6, which shows a section through the adapter housing 7 along a section line B-B marked in FIG. 3 and the axis of rotational symmetry A, a portion of the first discharge line 22*a* extends radially to the axis of rotational symmetry A in a transition region between the first pump working space 11*a* and a portion of the first discharge line 22*a* extending parallel to the axis of rotational symmetry A and merges into the portion of the first discharge line 22*a* extending parallel to the axis of rotational symmetry A by a right-angled deflection. A second discharge line 22*b* is connected to the second pump working chamber 11*b*. As shown in FIG. 7, which shows a section through the adapter housing 7 along a section line C-C marked in FIG. 3 and the axis of rotational symmetry B, a portion of the second discharge line 22*b* extends radially to the axis of rotational symmetry B in a transition region between the second pump working space 11*b* and a portion of the second discharge line 22*b* extending parallel to the axis of rotational symmetry B and merges into the portion of the second discharge line 22*b* extending parallel to the axis of rotational symmetry B by a right-angled deflection. Both discharge lines 22*a*,22*b* join to define a discharge port 23 defining a channel inside the discharge flange 17, the discharge port 23 having its rotational symmetry axis parallel to the rotational symmetry axes A, B. The discharge flange 17 defines a discharge flange opening 24. The discharge flange opening 24 simultaneously forms in the flange side 10 of the adapter housing 7 the opening of the discharge port 23 and of the discharge flange 17.

In parallel operation of both electric pumps connected to the pump working spaces 11*a*,11*b*, the coolant flows from the internal combustion engine 8 into the adapter housing 7 through the suction flange 15 which is connected to the internal combustion engine 8, flows through the suction port 20 and splits to the two suction pipes 21*a*,21*b* downstream of the suction port 20. The coolant is drawn towards the pump working spaces 11*a*,11*b*. The impellers (not shown) of the electric pumps force the coolant radially to the axes of rotational symmetry A, B into the discharge lines 22*a*,22*b*. The coolant flows along the two discharge lines 22*a*,22*b* until the coolant is recombined downstream of the discharge lines 22*a*,22*b* in the discharge port 23. The coolant exits the adapter housing 7 through the discharge flange 17 and flows back into the internal combustion engine 8. During individual operation of the electric pumps connected to the pump working chambers 11*a*,11*b*, the backflow flow valve 5 is in the blocking position. Accordingly, the coolant flows only through the released suction line 21*a*.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A pump device for use in a cooling circuit of an internal combustion engine of a commercial or motor vehicle, the pump device comprising:

two electric pumps in parallel; wherein each of the two electric pumps includes a switchable backflow valve included in a suction line so that the electric pumps are selectively operable individually or in parallel.

2. The pump device according to claim 1, wherein the switchable backflow valve of each of the two electric pumps is a 2/2-way valve.

3. The pump device according to claim 1, wherein the switchable backflow valve of each of the two electric pumps is pneumatically or electrically operable.

4. The pump device according to claim 1, wherein the switchable backflow valve of each of the two electric pumps prevents a backflow of a coolant in the cooling circuit when in a blocking position.

5. The pump device according to claim 1, wherein one of the electric pumps defines a main pump which is operated in a normal state and whose associated switchable backflow valve is in a flow position; and a second of the electric pumps defines a secondary pump which is switched off in the normal state and whose associated switchable backflow valve is in a blocking position.

6. The pump device according to claim 1, wherein the electric pumps are identical.

7. The pump device according to claim 1, further comprising:

an adapter housing in which the switchable backflow valves are provided; wherein the two electric pumps are attachable to the adapter housing and the adapter housing includes an interface permitting connection to the internal combustion engine.

8. The pump device according to claim 7, wherein the adapter housing includes a flange side to connect to the cooling circuit of the internal combustion engine, on which a suction flange with a third sealing surface and a discharge flange with a fourth sealing surface are provided;

the adapter housing includes a pump side, opposite to the flange side, to connect to the two electric pumps;

the adapter housing further includes:

a first discharge line and a second discharge line;

the suction lines;

a first pump working chamber adjoining a first of the suction lines and surrounded by a first sealing surface, and a second pump working chamber adjoining a second of the suction lines and surrounded by a second sealing surface; and a valve device including the two switchable backflow valves, which are adjustable between a blocking position and an open position;

the pump working chambers each define an opening in the pump side, the discharge flange is connected to the two discharge lines via a discharge port and the suction flange is connected to the two suction lines via a suction port; and each of the switchable backflow valves interacting with respective ones of the two suction lines and closing off the corresponding suction lines in the blocking position, and opening the corresponding suction lines in the open position.

9. The pump device according to claim 1, wherein the switchable backflow valves are operable from an outside of the pump device.

10. The pump device according to claim 9, wherein the suction port adjoins the suction flange opening downstream and divides into the two suction lines.

11. The pump device according to claim 8, wherein the suction port adjoins the suction flange opening downstream and divides into the two suction lines.

12. The pump device according to claim 8, wherein the discharge lines join to define the discharge port located upstream of a discharge flange opening.

13. The pump device according to claim 8, wherein the suction port has a larger cross-section than one of the suction lines.

14. The pump device according to claim 8, wherein the discharge port has a larger cross-section than that of one of the discharge lines.

15. The pump device according to claim 8, wherein a first one of the two switchable backflow valves is located in a transition region between the first suction line and the first pump working chamber, and a second one of the two switchable backflow valves is located in a transition region between the second suction line and the second pump working chamber.

16. A commercial vehicle comprising an internal combustion engine which can be cooled by a cooling circuit, and a pump device according to claim 1 which is adapted to circulate a coolant in the cooling circuit.

17. A commercial vehicle comprising an internal combustion engine which can be cooled by a cooling circuit, and a pump device according to claim 8 which is adapted to circulate a coolant in the cooling circuit; wherein the pump device is connected to the internal combustion engine of the commercial vehicle via the suction flange and the discharge flange.

18. A motor vehicle comprising an internal combustion engine which can be cooled by a cooling circuit, and comprising the pump device according to claim 1 to circulate a coolant in the cooling circuit.

19. A motor vehicle comprising an internal combustion engine which can be cooled by a cooling circuit, and comprising the pump device according to claim 8 to circulate a coolant in the cooling circuit; wherein the pump device is connected to the internal combustion engine of the motor vehicle via the suction flange and the discharge flange.

20. A method of operating the pump device according to claim 1, wherein the method comprises:

in an event that the required volume flow in the cooling circuit is low, operating the pump device in a single operation such that the backflow valve of the operated electric pump is brought into a flow position and the backflow valve of the switched-off electric pump is in a blocking position; and in a case that the required flow rate in the cooling circuit is higher than a predetermined level, operating the pumping device in a parallel mode with both of the electric pumps are operating and the backflow valves are in a flow position.

21. The method of claim 20, further comprising the steps of:

in an event of failure of one of the electric pumps, operating the other one of the electric pumps and setting the associated backflow valve to the flow position, and setting the backflow valve of the one of the electric pumps to the blocking position.

22. A method according to claim 20, wherein the pump device is included in a commercial or motor vehicle with an internal combustion engine, the internal combustion engine being coolable by a cooling circuit and the pump device being used to circulate coolant in the cooling circuit.

* * * * *